US005556575A

United States Patent [19]

Babaian-Kibala et al.

[11] Patent Number: 5,556,575

[45] Date of Patent: Sep. 17, 1996

[54] CORROSION INHIBITION IN REFINERIES USING THE REACTION PRODUCT OF HYDROCARBYL SUCCINIC ANHYDRIDE AND AN AMINE

[75] Inventors: Elizabeth Babaian-Kibala, Fulshear; Veronica K. Braden; Michael K. Poindexter, both of Sugar Land, all of Tex.; Christopher J. Murphy, Geneva, Ill.

[73] Assignee: Nalco/Exxon Energy Chemicals L.P., Sugarland, Tex.

[21] Appl. No.: 413,340

[22] Filed: Mar. 30, 1995

Related U.S. Application Data

[63] Continuation-in-part of Ser. No. 179,428, Jan. 10, 1994, abandoned.

[51] Int. Cl.[6] ..... C23F 11/14

[52] U.S. Cl. ..... 252/394; 262/392; 262/403; 262/405; 203/7; 208/47; 208/48 AA; 208/348

[58] Field of Search ..... 208/47, 48 AA, 208/348; 203/7; 252/392, 403, 405, 394

[56] References Cited

U.S. PATENT DOCUMENTS

| | | | |
|---|---|---|---|
| 2,490,744 | 12/1949 | Trigg et al. | 252/392 |
| 2,568,876 | 9/1951 | White | 422/16 |
| 2,742,498 | 4/1956 | Smith et al. | 252/392 X |
| 3,235,484 | 2/1966 | Colfer | 208/48 AA |
| 3,251,776 | 5/1966 | Gee et al. | 252/3 |
| 3,523,894 | 8/1970 | Jolly | 422/3 |
| 3,649,167 | 3/1972 | Sawyer | 422/16 |
| 3,658,494 | 4/1972 | Dorer, Jr. | 44/330 |
| 3,762,873 | 10/1973 | Alink | 422/12 |
| 4,062,764 | 12/1977 | White et al. | 422/16 |
| 4,192,844 | 3/1980 | Trace et al. | 422/16 |
| 4,326,987 | 4/1982 | Hendricks | 252/392 |
| 4,344,861 | 8/1982 | Levy | 507/244 |
| 5,171,420 | 12/1992 | Forester | 208/48 AA |
| 5,171,421 | 12/1992 | Forester | 208/48 AA |
| 5,194,142 | 3/1993 | Forester | 208/48 AA |
| 5,211,840 | 5/1993 | Lehrer | 208/47 X |

OTHER PUBLICATIONS

Scattergood et al., New Methods to Measure Corrosive Conditions Inside Crude Distillation Towers, NACE Corrosion 90 Meeting, Las Vegas, NV Apr. 23–27, 1990.

*Primary Examiner*—Sharon Gibson
*Assistant Examiner*—Valerie Fee
*Attorney, Agent, or Firm*—Robert A. Miller; James J. Drake

[57] ABSTRACT

Disclosed are a method for inhibiting corrosion in crude oil distillation towers, an improvement in crude oil fractionation, a method for dispersing iron sulfide in a hydrocarbon stream and a hydrocarbon dispersion using the reaction product of hydrocarbyl succinic anhydride and an amine. The reaction product has a molecular weight of from 500–800, the hydrocarbyl substituent has 6–20 carbon atoms, and the amine is selected from EDA, DETA, TETA, TEPA, PEHA, AEP, piperazine, 1,2-PDA, 1,3-PDA, IBPA, MDA or HMDA. The imide product is a filming inhibitor used to treat metal surfaces subject to mineral acid corrosion and disperse iron sulfide particles by adding 3 to 24 ppm to sweet or sour crude contacting the metal surfaces.

28 Claims, No Drawings

CORROSION INHIBITION IN REFINERIES USING THE REACTION PRODUCT OF HYDROCARBYL SUCCINIC ANHYDRIDE AND AN AMINE

This application is a continuation-in-part of U.S. application Ser. No. 08/179,428 filed on Jan. 10, 1994, now abandoned.

FIELD OF THE INVENTION

The present invention relates to inhibiting mineral acid corrosion of metallic surfaces in hydrocarbon processing equipment, and more particularly to the use of film-forming compounds comprising the reaction product of substituted succinic anhydride and an amine.

BACKGROUND OF THE INVENTION

Corrosion is a problem in many refineries, particularly crude oil distillation towers. Conventional methods used to measure and control corrosion inside crude distillation towers are discussed in Bieber et al., "New Methods to Measure Corrosive Conditions Inside Crude Distillation Towers", National Association of Corrosion Engineers, Corrosion '90 Meeting, 1990. In the overhead of a crude unit distillation tower, acidic compounds generally cause corrosion when condensed at the dew point of water. Analysis of the dew point water sample shows that the acidic species present are comprised mainly of hydrochloric acid with small amounts of sulfoxy and various organic acids.

It has been known to use amines as neutralizing agents to decrease the corrosion caused by the acids in the system. It has also been known to use organic filmers to impair the attack of the acids on the metal surfaces. Often, a corrosion control program for the overhead of a crude distillation tower will employ a combination of a filmer and a neutralizer.

Neutralizing amines have been injected into the crude charge to the column, into the overhead reflux return or pumparound return, or directly into the dew point water region of the tower. Neutralizing amines generally have a low molecular weight to form soluble chloride salts to reduce the amount of available hydrochloric acid. When there is less available acid, there is less corrosion. However, insoluble amine hydrochloride salts which are solids under conditions in the column can foul or plug column trays. Care must also be taken when selecting the amine since some amine hydrochloride salts can also be corrosive to tray metallurgy.

Filmers generally have a polar end and a non-polar end. The polar end contains one or more heteroatoms and the non-polar ends generally comprise hydrocarbon chains. It is commonly believed that the filmer chemisorbs to the metal surface when the lone pair of electrons on the heteroatom interacts with the empty d orbital of the metals. The hydrophobic chain of the non-polar end facilitates solubility in the hydrocarbon fluid to which it is added, and also helps after chemisorption to hinder the approach of corrosive species to the metal surface.

The mechanism of inhibitor interaction with the metal surface is usually described by the chemisorption process. However, typical metal surfaces in refinery equipment are usually covered with corrosion products, such as sulfides or oxides of iron, that interact with the metal surface and remain on the surface. The presence of these corrosion products is generally beneficial. For example, if the formation of iron sulfide is slow and the sulfide film formed thereby is persistent and stays on the metal surface, then a barrier to corrosion can be formed. This barrier hinders the further attack of corrosive species to the metal surface.

A filmer can protect the metal surface either by interacting with the iron sulfide, or by interacting with the metal surface directly where iron sulfide protection is inadequate. Thus, a filmer that works well in a "sour" application (where $H_2S$ is present) may not work well in a "sweet" system (without sulfides).

Corrosion in crude distillation towers generally occurs in the hydrocarbon processing equipment wherein the hydrocarbon can typically include 5 to 10 weight percent water, typically employed for steam stripping and/or water washing distillation overheads, but it is typically free of molecular oxygen. The conditions for corrosion are generally above the boiling point of water, typically from about 100° C. to about 230° C., at slightly acidic conditions, e.g. a pH in the range of 5 to 7. These corrosive conditions are generally found in the upper portion of the column where water condenses. Thus, filming inhibitors are usually injected into the reflux return, a pumparound return, or directly into the dew point region of the tower.

Underdeposit corrosion can occur when corrosive agents are trapped by a surface deposit. Such type corrosion can be inhibited by minimizing the presence of deposit-forming materials. A very commonly found deposit material in hydrocarbon processing equipment is iron sulfide which has been deposited relatively quickly without allowing good molecular packing (as opposed to the slowly formed, structurally stable iron sulfide which can form a protective film as mentioned above). Underdeposit corrosion can, to a large extent, be prevented by inhibiting the deposition of iron sulfide particles.

As another consideration for inhibiting corrosion in crude distillation towers, any added chemical must not adversely affect the properties of the distillate. For example, filming amines can cause low values for the water separation index (modified WSIM; ASTM D3948), particularly if used at high treat rates.

Distillation tower corrosion and its control can further be distinguished from the usual types of corrosion which occur in, for example, oil field equipment. Oxygen corrosion, for example, occurs wherever equipment is exposed to atmospheric oxygen, most frequently in offshore installations, brine-handling and injection systems and in shallow producing wells where air is allowed to enter the well. Many corrosion inhibitors which work well in the relatively mild corrosion environment of oil field equipment are not effective in the more severe corrosion environment of crude distillation towers.

U.S. Pat. No. 3,762,873 to Oude Alink discloses the inhibition of corrosion and scale formation in oxygenated systems such as brines, cooling systems, auto radiator systems, drilling muds, etc. using substituted succinimides. The succinimides are said to be obtained by reacting a hydrocarbon succinate with an amine at a preferred mole ratio from 0.8 to 1 of amine to succinic anhydride.

SUMMARY OF THE INVENTION

It has been discovered that mineral acid corrosion of metallic surfaces in hydrocarbon processing equipment, particularly crude distillation towers, can be inhibited by treatment with an inhibitor comprising the reaction product of a hydrocarbyl-substituted succinic anhydride and an amine. The inhibitor preferably contains one, but more preferably two or more imide groups. In one aspect, the invention provides a method for inhibiting acid corrosion of metallic surfaces in hydrocarbon processing equipment. The method includes contacting the surfaces with an effective amount of a film-forming compound comprising the reaction product of hydrocarbyl succinic anhydride and an amine in an essentially molecular oxygen free environment. The surface contacting step preferably includes adding the reaction product, which can be the preferred succinimide, to a hydrocarbon stream containing acid which contacts the surface. The hydrocarbon stream feeds, for example, to a crude distillation tower, such as the crude charge to the tower or overhead piping, such as the reflux return or a pumparound return line. The succinimide dosage is preferably at a rate of from 0.1 to 100 ppm, by weight of the hydrocarbon stream, more preferably from 3 to 24 ppm.

The hydrocarbyl substituent of the preferred succinimide is preferably alkyl or alkenyl from about 5 to about 50 carbon atoms, more preferably from 6 to 20 carbon atoms. The succinimide can be a monoimide, but is preferably a diimide or a triimide having a molecular weight from about 400 to about 2000, more preferably from about 500 to about 800. A diimide can be obtained, for example, by stoichiometrically reacting two moles of the hydrocarbyl succinic anhydride with one mole of a polyamine containing two primary amine groups. A triimide can be obtained, for example, by stoichiometrically reacting three moles of the hydrocarbyl succinic anhydride with one mole of a polyamine containing three primary amine groups. The polyamine can be selected from ethylenediamine, diethylenetriamine, triethylenetetramine, tetraethylenepentamine, pentaethylenehexamine, aminoethylpiperazine, piperazine, propylenediamine, 1,3-diaminopropane, iminobispropylamine methyldiamine, hexamethylenediamine, melamine, and the like. Suitable corrosion inhibition is obtained when the hydrocarbyl substituent is dodecenyl and the polyamine is diethylenetriamine, triethylenetetramine, or tetraethylenepentamine. A polyimide inhibitor is preferably essentially free of reactive gum- or sludge-forming amine groups.

In another aspect, the present invention provides an improvement to a crude oil fractionation method. The method includes fractionating crude oil in a distillation tower, wherein metal surfaces in the tower are subject to mineral acid corrosion conditions at a temperature from about 100° C. to about 230° C., and adding a corrosion inhibitor to a hydrocarbon stream introduced to the tower. The improvement is that the corrosion inhibitor comprises an effective amount of the film-forming reaction product of hydrocarbyl succinic anhydride and a polyamine as described above.

DESCRIPTION OF THE PREFERRED EMBODIMENTS

The following examples are presented to describe preferred embodiments and utilities of the invention and are not meant to limit the invention unless otherwise stated in the claims appended hereto.

A film-forming hydrocarbyl succinimide compound inhibits mineral acid corrosion in a crude oil atmospheric distillation tower in both high and low sulfide conditions. In addition, such succinimide compounds can disperse iron sulfide particles and reduce the possibility of underdeposit corrosion.

The film-forming corrosion inhibitor of the present invention comprises the reaction product of a hydrocarbyl succinic anhydride and an amine. A suitable hydrocarbyl succinic anhydride reactant of the present invention has the formula:

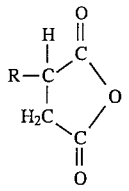

wherein R is a hydrocarbyl group having from about 5 to about 50 carbon atoms, but is preferably a hydrocarbyl group having from about 6 to about 20 carbon atoms. The hydrocarbyl group preferably comprises an alkyl or alkenyl group which can be a straight or branched chain, or a cyclic or aromatic group. Dodecenylsuccinic anhydride (DDSA) has been found to be an especially useful hydrocarbyl succinic anhydride in the present invention. Another suitable hydrocarbyl succinic anhydride is an α-olefin succinic anhydride (AOSA) wherein the α-olefin group is a mixture of $C_{12}$–$C_{26}$ moieties.

DDSA, for example, is prepared as the reaction product of 1-dodecene and maleic anhydride at equimolar proportions at an elevated temperature by methods well known in the art. AOSA is prepared by the reaction product of a $C_{12}$–$C_{26}$ olefin/paraffin mixture and maleic anhydride. While maleic anhydride is a preferred starting material for producing the hydrocarbyl succinic anhydride reactant due to its widespread commercial availability, other hydrocarbyl anhydrides formed by the reaction product of an alkene and an alternative unsaturated anhydride or dicarboxylic acid compound could be used. Examples of alternative unsaturated anhydride or acid starting materials include citraconic acid, itaconic acid, and the like.

DDSA is reacted with an amine to produce the preferred dodecenylsuccinimide compound of the present invention. Suitable amines generally have one, but preferably two or more primary amine groups. An example of a suitable monoamine having a single primary amine group which can react with DDSA to form a monoimide compound is ethyleneamine (EA).

Examples of suitable polyamines having two primary amine groups which react with DDSA, for example, at a suitable molar proportion to form a diimide compound include polyalkylamine, ethylenediamine (EDA), diethylenetriamine (DETA), triethylenetetramine (TETA), tetraethylenepemamine (TEPA), pentaethylenehexamine (PEHA), 1,3 diaminopropane (1,3-PD), 1,2 diaminopropane (1,2-PDA), iminobispropylamine (IBPA), methanediamine (MDA), and hexamethylenediamine (HMDA). Preferred polyamines include diethylenetriamine, triethylenetetramine, and tetraethylenepentamine.

Examples of suitable polyamines having three terminal primary amine groups which react with DDSA, for example, at a suitable molar proportion to form a triimide compound include iminotrispropylamine, iminotrisethylamine, melamine, and the like.

Other suitable amines include compounds having a combination of primary and/or secondary amine groups, or a combination of amine groups and alcohol and/or ether groups. Suitable examples include dimethylaminopropylamine (DMAPA), piperazine, ethoxypropylamine, aminoethylpiperizine (AEP), aminopropylpiperazine, aminoethyl ethanolamine, aminopiperazinethanolamine, aminopropylpropylether, and the like. The reactive secondary amines (such as piperazine) form acid-amides which can be suitable corrosion inhibitors.

The monoimide corrosion inhibitor of the present invention can be made by stoichiometrically reacting one mole of the hydrocarbylsuccinic anhydride with one mole of an amine compound containing one primary amine group such as ethyleneamine (EA). Alternatively, a monoimide-containing succinimide inhibitor can be made by reacting the anhydride and a polymine containing two primary amine groups at less than stoichiometric proportions (e.g. one or more but less than two moles anhydride per mole polyamine).

The polyimide corrosion inhibitors of the present invention can be prepared by reacting the hydrocarbyl succinic anhydride and the polyamine at molar proportions so that a resulting inhibitor is essentially free of reactive amine groups which can potentially react in the crude oil environment to produce gum and/or sludge materials. Specifically, diimide succinimides are preferably prepared by stoichiometrically reacting two moles of the hydrocarbyl succinic anhydride with one mole of a polyamine containing two primary amino groups.

Preferred triimide succinimides are prepared by stoichiometrically reacting three moles of the hydrocarbyl succinic anhydride with one mole of a polyamine containing three primary amino groups.

Suitable succinimides have a molecular weight of from about 400 to about 2000, but preferably from about 500 to about 800.

The film-forming succinimide corrosion inhibitor and iron sulfide dispersant of the present invention is added to a hydrocarbon process stream which is subject to acid attack at a dosage of from 0.1 to about 100 ppm by weight of the hydrocarbon stream, and preferably at a dosage of from about 3 to about 24 ppm by weight of the hydrocarbon stream. The present succinimide corrosion inhibitor is particularly useful in an acid and acid salt-containing multi-component hydrocarbon process stream which is processed in the presence of steam in an atmospheric distillation tower, essentially free of molecular oxygen.

Typically, such towers have multi-component hydrocarbon streams containing from 5 to 10 percent by weight dispersed water due to the added stripping steam. Corrosive acid components tending to accumulate in a water condensate phase include mineral acids such as hydrochloric acid and a minor amount of sulfoxy acids, and organic carboxylic acids such as acetic, propionic, butyric acid, and the like organic acids up to about $C_7$. Generally, hydrochloric acid is the primary corrosive acid present with only minor proportions of other types of acids.

For best results, the present succinimide corrosion inhibitor is added to the hydrocarbon process stream in the vicinity of the location in the tower subject to corrosion due to acid attack. Since the acid condensing location in the tower is at cool upper trays subject to water condensation, the present corrosion inhibitor is preferably added to the hydrocarbon process stream at the upper portions of the tower including overhead piping such as the tower reflux and/or pumparound lines, product draw lines and the pump suctions of the turnaround and reflux pumps. In addition, the present succinimide corrosion inhibitor can be added directly by installation of corrosion inhibitor injection lines at the trays subject to corrosion due to acid attack.

Trays subject to water condensation and accumulation are those trays operating at or near the steam condensation temperature (dew point) including the condensation temperature of steam-based azeotropes with azeotrope-forming components such as hydrogen chloride and/or hydrocarbon vapor. Azeotrope components are known to raise the boiling point temperature of steam thus permitting steam to condense at upper trays operating at a temperature above the ordinary atmospheric boiling point of water. Thus water condensate containing hydrochloric acid can accumulate in atmospheric distillation tower upper trays operating at a temperature of from 100° C. to 230° C.

The succinimide corrosion inhibitor additive of the present invention is preferably used as a concentrate of succinimide and any other active components such as a neutralizer amine in a heavy aromatic naphtha. The concentrate will typically contain from about 20 to about 80 percent by weight active components and from about 20 to about 80 percent by weight of the heavy aromatic naphtha diluent.

EXAMPLES

Wheelbox coupon corrosion tests were conducted to evaluate succinimide corrosion inhibitors of the present invention with comparative corrosion inhibitors. The tests were conducted at 71° C. in a rotary oven. The coupons used were rod shaped and made of carbon steel which had been water quenched and hardened. To prepare the coupons, metal surfaces were sand blasted, washed in alcohol and dried in an oven. Suitably prepared coupons were weighed and placed individually in sample bottles.

An acidic agent was made up comprising 25 % by volume of a 0.1N aqueous solution of HCl and 75 % by volume of a paraffinic hydrocarbon. If $H_2S$ was used to simulate sulfide conditions, the paraffinic hydrocarbon used was sparged with $H_2S$. Each bottle was dosed with a measured amount of the inhibitor. Finally, the coupons were placed in the bottles which were then capped and shaken.

The oven was heated to 71° C. and loaded with the coupon containing bottles. The bottles were rotated in the oven for a period of 20 hours then the heat was discontinued. Then the bottles were rotated for an additional 1.5 hours while cooling to about 27° C. After cleaning and drying in an oven at 80° C., the coupons were reweighed and a percent corrosion inhibition was calculated using the formula: (average blank weight loss—weight loss of treated coupon)/average blank weight loss×100. Each coupon was also visually inspected and the appearance was recorded.

In one set of corrosion tests, the bottle headspace was air. In another set of corrosion tests, additional steps were taken to exclude most of the air. Where a substantially air-free environment was desired, argon was bubbled through both the acid aqueous solution and the solvent.

Example 1

A dodecenylsuccinimide compound of the present invention was prepared according to the following procedure. DDSA and heavy aromatic naphtha solvent were placed in a three-neck round bottom flask equipped with a stir bar, temperature controller, Dean-Stark trap, and a condenser. After assembling the glassware, a stoichiometric amount of the desired amine was added. The reaction mixture was heated to approximately 180° C. for 2 hours and the water formed during the reaction was collected into the Dean-Stark trap.

Examples 2–10 and Comparative Example 1

Various succinimide corrosion inhibitors were prepared similarly to the procedure described in Example 1 by reacting a succinic anhydride with an amine having primary amine groups. In addition, several imides were prepared by reacting DDSA with an amine having primary amine and secondary amine groups. An acid-amide was prepared by reacting DDSA with an amine having primary amine groups and alcohol groups.

Wheelbox coupon corrosion testing was undertaken to screen the various succinimide corrosion inhibitors prepared above and a succinimide obtained commercially. Composition of the various corrosion inhibitors and test results are presented in Table 1 in terms of percent corrosion inhibition versus parts per million of inhibitor actives to evaluate the inhibitor performance.

Results indicate that mono- and di-succinimides give excellent corrosion inhibition at a dosage between 5–20 ppm actives. Performance was improved by increasing the length of the imide chain, i.e. increasing the number of ethyleneamine repeat units in the polyamine from 1–2 to 3–5. Inhibitors made using amines comprising only secondary amine and alcohol groups generally gave inferior performance to those inhibitors made with amines having primary amine groups.

TABLE 1

| | Inhibitor Composition | | | Percent Inhibition | | |
|---|---|---|---|---|---|---|
| | | | Ratio - Anhydride: | Inhibitor Concentration (ppm actives) | | |
| Example | Anhydride | Polyamine | Polyamine | 5 | 10 | 20 |
| 2 | DDSA | TETA | 2:1 | 83 | 85 | 91 |
| 3 | DDSA | DETA | 2:1 | 0 | −2 | 54 |
| 4 | DDSA | PEHA | 2:1 | 86 | 87 | 88 |
| 5 | DDSA | aminopropyl-propylether | 2:1 | 14 | 42 | 96 |
| 6 | DDSA | EDA | 2:1 | 3 | 0 | −1 |
| 7 | DDSA | amminopiperazine-ethanolamine | 1:1 | −1 | −1 | 1 |
| 8 | DDSA | aminoethyl-ethanolamine | 1:1 | −3 | 16 | 27 |
| 9 | AOSA | ethyleneamine | — | 90.5 | 92 | 95 |
| 10 | DDSA | TETA | — | 19 | 64 | 83 |
| Comp. 1 | | Lubrizol 2600 (60% actives) | | −4 | −4 | −5 |

Example 11–14

Wheelbox corrosion tests were performed in the manner set forth above on a selected succinimide inhibitor wherein the ratio of anhydride to a polyamine was varied from 1.5–2:1. Results are given in Table 2. It can be seen that statistically discernible differences in performance were not evident.

Examples 15–18

Additional wheelbox corrosion tests were run in the manner set forth above on a DDSA/TETA diimide corrosion inhibitor to test for performance variance with manufacture batch. Results given in Table 2 indicate that there was no statistically significant variance in performance with manufacture batch.

Examples 19–22

Additional wheelbox corrosion tests were run in the manner set forth above on two promising succinimide inhibitors to determine performance variance in the presence of S. Results shown in Table 2 indicate that the corrosion inhibitors of the present invention have good performance in a sour ($H_2S$) environment.

TABLE 2

| | Inhibitor Composition | | | Percent Inhibition (Std. Dev.) | | | |
|---|---|---|---|---|---|---|---|
| | | | Ratio-Anhydride: | Inhibitor Concentration (ppm actives) | | | |
| Example | Anhydride | Polyamine | amine | 3 | 5 | 10 | 20 |
| 11 | DDSA | TETA | 2:1 | — | 77 | 81 | 89 |
| 12 | DDSA | TETA | 2:1 | — | 81 | 82 | 73 |
| 13 | DDSA | TETA | 1.5:1 | — | 80 | 84 | 90 |
| 14 | DDSA | TETA | 1.7:1 | — | 82 | 82 | 78 |
| 15 | DDSA | TETA | 2:1 | — | 77 | 62 | 88 |
| 16 | DDSA | TETA | 2:1 | — | 80 | 81 | 76 |
| 17 | DDSA | TETA | 2:1 | — | 85 | 89 | 91 |
| 18 | DDSA | TETA | 2:1 | — | 88 | 88 | 91 |
| 19* | AOSA | EA | — | 58 (26.2) | 85 (8.3) | 94 (0.3) | 95 (0.3) |

TABLE 2-continued

| Inhibitor Composition | | | | Percent Inhibition (Std. Dev.) Inhibitor Concentration (ppm actives) | | | |
|---|---|---|---|---|---|---|---|
| Example | Anhydride | Polyamine | Ratio-Anhydride: amine | 3 | 5 | 10 | 20 |
| 20* | DDSA | TETA | — | 51 (2.5) | 54 (5.7) | 71 (4.2) | 63 (14.0) |
| 21 | AOSA | EA | — | 49 (6.8) | 70 (4.4) | 90 (2.6) | 94 (0.8) |
| 22 | DDSA | TETA | — | 40 (9.2) | 80 (4.0) | 92 (1.4) | 96 (1.2) |

* — In the presence of $H_2S$.

The foregoing description of the invention is illustrative and explanatory thereof. Various changes in the materials, apparatus, and particular parts employed will occur to those skilled in the art. It is intended that all such variations within the scope and spirit of the appended claims be embraced thereby.

I claim:

1. A method for inhibiting acid corrosion of metallic surfaces hydrocarbon distillation towers comprising: contacting the surfaces of said distillation tower with an effective amount of a film-forming mono, di, or tri-imide reaction product of a hydrocarbyl succinic anhydride and an amine having at least one primary amine group, wherein the hydrocarbyl substituent of the hydrocarbyl succinic anhydride is selected from the group consisting of alkyl or alkenyl group containing from about 5 to about 50 carbon atoms, said mono, di, or tri-imide reaction product having a molecular weight of from about 400 to about 2,000.

2. The method of claim 1, wherein the hydrocarbyl substituent has from 6 to 20 carbon atoms.

3. The method of claim 1, wherein the reaction product is a diimide.

4. The method of claim 3, wherein the molecular weight of the diimide reaction product is from about 500 to about 800.

5. The method of claim 3, wherein the amine is selected from the group consisting of ethylenediamine, diethylenetriamine, triethylenetetramine, tetraethylenepentamine, pentaethylenehexamine, propylenediamine, 1,3-diaminopropane, iminobispropylamine, methanediamine, hexamethylenediamine and melamine.

6. The method of claim 3, wherein the hydrocarbyl substituent comprises dodecenyl and the amine comprises diethylenetriamine, triethylenetetramine or tetraethylenepentamine.

7. The method of claim 1, wherein the reaction product is a monoimide which can be obtained by reacting the hydrocarbyl succinic anhydride with an amine containing one primary amine group.

8. The method of claim 1, wherein the reaction product is a diimide which is obtained by stoichiometrically reacting two moles of the hydrocarbyl succinic anhydride with one mole of a polyamine containing two primary amine groups.

9. The method of claim 1, wherein the reaction product is a triimide which is obtained by stoichiometrically reacting three moles of the hydrocarbyl succinic anhydride with one mole of a polyamine containing three primary amine groups.

10. The method of claim 1, wherein the reaction mono, di, or tri-imide product is essentially free of reactive gum- or sludge-forming amine groups.

11. The method of claim 1, wherein the surface contacting step comprises adding mono, di, or tri-imide reaction product to a hydrocarbon stream containing an acid which contacts the surface.

12. The method of claim 11, wherein the mono, di, or tri-imide reaction product is added to the hydrocarbon stream at from 0.1 to 100 ppm by weight of said hydrocarbon stream.

13. The method of claim 12, wherein mono, di, or tri-imide reaction product is added to the hydrocarbon stream at from 3 to 24 ppm by weight.

14. The method of claim 12, wherein the hydrocarbon distillation tower is a crude oil distillation tower.

15. The method of claim 14, wherein the hydrocarbon stream passes through overhead piping to or from the distillation tower.

16. The method of claim 11, further comprising adding a neutralizing amine to the hydrocarbon stream.

17. The method of claim 1, further comprising subjecting the contacted surfaces to acid corrosion conditions at a temperature of from about 100° C. to about 230° C.

18. In a method comprising fractionating crude oil in a distillation unit in an essentially molecular oxygen free environment wherein metal surfaces in the unit are subjected to acid corrosion conditions at a temperature of from about 100° C. to about 230° C., and adding a corrosion inhibitor to a hydrocarbon stream introduced to the unit, the improvement comprising using as the corrosion inhibitor: A. an effective amount of the film-forming di, or tri-imide reaction product of a hydrocarbyl succinic anhydride and an amine, having two or three primary amine groups wherein the hydrocarbyl substituent is selected from the group consisting of alkyl and alkenyl groups having from about 6 to 20 carbons atoms and wherein the product has a molecular weight of from about 500 to about 800 and is essentially free of reactive gum- or sludge-forming amine groups; and, B. optional neutralizing amine.

19. The improvement of claim 18 wherein the film-forming di or tri-imide reaction product is employed at an addition rate of from 0.1 to 100 ppm by weight of the hydrocarbon stream.

20. The improvement of claim 19, wherein the amine is diethylenetriamine, triethylenetetramine or tetraethylene pentamine and the addition rate is from 3 to 24 ppm by weight of the hydrocarbon stream.

21. The improvement of claim 18, wherein the crude oil fractionated in the distillation unit is a sweet crude.

22. The improvement of claim 18, wherein the crude oil fractionated in the distillation unit is a sour crude.

23. A method for dispersing iron sulfide particles in hydrocarbon processing equipment processing a hydrocarbon feed stream in an environment essentially free of molecular oxygen at a temperature of from about 100° C., to about 230° C., comprising introducing an effective amount of an iron sulfide dispersant to said hydrocarbon feed stream the dispersant being the reaction product of a hydrocarbyl succinic anhydride and an amine, wherein the hydrocarbyl substituent of the hydrocarbyl succinic anhydride is selected from the group consisting of alkyl or alkenyl groups containing from about 5 to about 50 carbon atoms; the product having a molecular weight of from about 500 to about 800.

24. A hydrocarbon dispersion, comprising: A. a hydrocarbon stream essentially free of molecular oxygen containing from about 0.1 to about 100 ppm by weight of a dispersant comprising the reaction product of a hydrocarbyl succinic arthydride and an amine, wherein the hydrocarbyl substituent of the hydrocarbyl succinic arthydride is selected from the group consisting of alkyl or alkenyl groups containing from about 5 to about 50 carbon atoms, the reaction product having a molecular weight of from about 500 to about 800; and B. iron sulfide particles effectively dispersed by the dispersant.

25. A method for inhibiting acid corrosion on the metallic surfaces of hydrocarbon distillation towers comprising: contacting the surfaces of said distillation towers with an effective amount of a film-forming corrision inhibitor which is the acid-amide reaction product of a hydrocarbyl succinic anhydride with an amine, wherein the hydrocarbyl substituent of the hydrocarbyl succinic anhydride is selected from the group consisting of alkyl or alkenyl groups containing from about 5 to about 50 carbon atoms and wherein the acid-amide reaction product is obtained by reacting the hydrocarbyl succinic anhydride with an amine containing at least one reactive secondary amine, said acid-amide reaction product having a molecular weight of from about 400 to about 2,000.

26. The method of claim 25 wherein the hydrocarbyl substituent has from 6 to 20 carbon atoms.

27. The method of claim 25 wherein the molecular weight of the acid-amide reaction product is from about 500 to 800.

28. The method of claim 25 wherein the secondary amine is selected from the group consisting of piperazine, aminoethylpiperazine and aminopiperazine.

* * * * *

UNITED STATES PATENT AND TRADEMARK OFFICE

CERTIFICATE OF CORRECTION

PATENT NO. : 5,556,575

DATED : 9/17/96

INVENTOR(S) : ELIZABETH BABAIAN-KIBALA, ET AL

It is certified that error appears in the above-indentified patent and that said Letters Patent is hereby corrected as shown below:

CLAIM 1

1. A method for inhibiting acid corrosion occuring on the metallic surfaces of a hydrocarbon distillation tower_ operating in an essentially molecular oxygen free environment comprising_ contacting the surfaces of a film-forming mono, di, or tri-imide reaction product of a hydrocarbyl succinic anhydride and an amine having at least one primary amine group, wherein the hydrocarbyl substituent of the hydrocarbyl succinic anhydride is selected from the group consisting of alkyl or alkenyl groups, containing from about 5 to about 50 carbon atoms, said mono, di, or tri-imide reaction product having a molecular weight of from about 400 to about 2,000.

UNITED STATES PATENT AND TRADEMARK OFFICE

CERTIFICATE OF CORRECTION

PATENT NO. : 5,556,575

DATED : 9/17/96

INVENTOR(S) : ELIZABETH BABAIAN-KIBALA, ET AL

It is certified that error appears in the above-indentified patent and that said Letters Patent is hereby corrected as shown below:

COLUMN 10, CLAIM 11, LINE 18 step comprises adding mono, di, or tri-imide reaction prod-

LETTERS PATENT SHOULD READ AS:

step comprises adding <u>the</u> mono, di, or tri-imide reaction prod-

COLUMN 10, CLAIM 13, LINE 25

13. The method of claim 12, wherein mono, di, or

LETTERS PATENT SHOULD READ AS:

13. The method of claim 12, wherein <u>the</u> mono, di, or

UNITED STATES PATENT AND TRADEMARK OFFICE

CERTIFICATE OF CORRECTION

PATENT NO. : 5,556,575

DATED : 9/17/96

INVENTOR(S) : ELIZABETH BABAIAN-KIBALA, ET AL

It is certified that error appears in the above-indentified patent and that said Letters Patent is hereby corrected as shown below:

COLUMN 10, CLAIM 18, LINE 52 optional neutralizing amine.

LETTERS PATENT SHOULD READ AS:

<u>an</u> optional neutralizing amine.

COLUMN 11, CLAIM 23, LINE 3 of an iron sulfide dispersant to said hydrocarbon feed stream

LETTERS PATENT SHOULD READ AS:

of an iron sulfide dispersant to said hydrocarbon feed stream<u>;</u>

UNITED STATES PATENT AND TRADEMARK OFFICE

CERTIFICATE OF CORRECTION

PATENT NO. : 5,556,575

DATED : 9/17/96

INVENTOR(S) : ELIZABETH BABAIAN-KIBALA

It is certified that error appears in the above-indentified patent and that said Letters Patent is hereby corrected as shown below:

COLUMN 11, CLAIM 24, LINE 10

24. A hydrocarbon dispersion, comprising: A. a hydro-

LETTERS PATENT SHOULD READ AS:

24. A hydrocarbon dispersion_ comprising: A. a hydro-

Signed and Sealed this

Seventh Day of October, 1997

*Attest:*

*Attesting Officer*

Bruce Lehman

BRUCE LEHMAN

*Commissioner of Patents and Trademarks*